United States Patent [19]

Allen, Jr. et al.

[11] Patent Number: 4,669,960

[45] Date of Patent: Jun. 2, 1987

[54] FLUID PRESSURE SENSOR

[75] Inventors: Clifford W. Allen, Jr.; Ronn J. Leaf, both of Lexington, Ky.

[73] Assignee: Lexair, Inc., Lexington, Ky.

[21] Appl. No.: 705,783

[22] Filed: Feb. 26, 1985

[51] Int. Cl.[4] ..... F04B 21/00; F01M 1/18

[52] U.S. Cl. ..... 417/63; 184/6.4; 116/267; 340/626

[58] Field of Search ..... 417/63, 13, 281, 228; 184/6.4; 116/267; 73/744; 418/2; 340/626

[56] References Cited

U.S. PATENT DOCUMENTS

| | | | |
|---|---|---|---|
| 2,017,684 | 10/1935 | Pritterden | 417/281 |
| 2,199,426 | 5/1940 | Wolfert | 184/6.4 |
| 2,937,801 | 5/1960 | Berkobon | 417/281 |
| 3,026,387 | 3/1962 | Ashbaugh | 184/6.4 |
| 3,127,586 | 3/1964 | Heyn et al. | 184/6.4 |
| 3,199,770 | 8/1965 | Shirey | 417/281 |
| 3,500,958 | 3/1970 | Callahan et al. | 184/6.4 |
| 3,934,238 | 1/1976 | Pavlou | 340/626 X |
| 4,256,437 | 3/1981 | Brown | 417/63 |
| 4,336,001 | 6/1982 | Andrew | 417/63 |
| 4,498,495 | 2/1985 | Worwood et al. | 116/267 |
| 4,525,125 | 6/1985 | Matsumoto | 417/44 |
| 4,551,069 | 11/1985 | Gilmore | 417/13 |

FOREIGN PATENT DOCUMENTS

| | | | |
|---|---|---|---|
| 47903 | 3/1979 | Japan | 417/63 |
| 891246 | 3/1962 | United Kingdom | 116/117 |

*Primary Examiner*—Carlton R. Croyle
*Assistant Examiner*—Paul F. Neils
*Attorney, Agent, or Firm*—Frank C. Leach, Jr.

[57] ABSTRACT

An actual pressure of a fluid having an ambient pressure as part thereof is sensed by a sensor. When the actual pressure decreases below a predetermined pressure, a signal is produced. If desired, the sensor may cause production of the signal when the actual pressure of the fluid exceeds a predetermined pressure.

12 Claims, 5 Drawing Figures

FLUID PRESSURE SENSOR

This invention relates to a fluid pressure sensor and, more particularly, to a fluid pressure sensor for sensing the actual pressure of a fluid relative to a predetermined pressure.

In a compressor, for example, having a varying ambient pressure in its crankcase because of a varying supply of fluid thereto such as disclosed in U.S. Pat. No. 4,413,951 to Allen, for example, it is desired to know when the actual pressure of lubricating oil supplied from an oil pump within the crankcase falls below a predetermined pressure at which sufficient lubrication of the parts of the compressor will not be obtained. This predetermined pressure is substantially lower than the operating pressure range of the oil pump.

Because of the varying pressure in the crankcase and the oil pump having its intake pipe connected to the crankcase to receive the oil therefrom, the discharge pressure of the oil from the pump includes the crankcase pressure. Because this crankcase pressure varies substantially due to the varying supply of fluid to the compressor crankcase, a sensor responsive to the total pressure of the oil discharged from the oil pump will not indicate the actual pressure of the oil. Thus, if the sensor were to produce a signal only when the total oil pressure was less than a predetermined pressure but the ambient pressure was relatively high, no signal would be produced even if the actual pressure was below the safe operating pressure. Accordingly, it is necessary to be able to sense the actual pressure of the oil which is the difference between the total pressure of the oil discharged from the pump and the crankcase pressure to insure that the actual pressure of the oil from the pump is sufficiently high to lubricate the parts of the compressor.

The fluid pressure sensor of the present invention satisfactorily solves the foregoing problem through utilizing a slidable piston having the crankcase pressure acting on both sides of the piston by having one side of the piston subjected only to the crankcase pressure and the other side subjected to the discharge pressure from the oil pump whereby this includes both the actual pressure of the oil and the crankcase pressure. Thus, the position of the piston is dependent solely on the actual pressure of the oil from the oil pump, and the position of the piston when the actual pressure of the oil from the oil pump is below a predetermined pressure is employed to produce a signal to indicate such.

Various types of pressure sensors are shown and described in U.S. Pat. Nos. 3,375,720 to Whiting, 3,429,291 to Hoffman, 4,014,284 to Read, 4,026,153 to Silverwater, and 4,203,384 to Silverwater. However, these patents do not recognize the problem solved by the fluid pressure sensor of the present invention.

An object of this invention is to provide a fluid pressure sensor sensing the actual pressure of a fluid supplied from pressurizing means in which the intake pressure of the fluid supplied to the pressurizing means includes a varying ambient pressure.

Another object of this invention is to provide an oil pressure sensor for sensing the discharge pressure of an oil pump having its intake connected to a compressor crankcase having a varying pressure.

Other objects of this invention will be readily perceived from the following description, claims, and drawings.

This invention relates to a fluid pressure sensor for always indicating when the actual pressure of an oil supplied from a pump in which the pump receives the oil from a comprissor crankcase having a varying pressure has changed from the condition of being greater or lesser than a predetermined pressure to the opposite condition where the total pressure of the oil supplied from the pump includes both the actual pressure of the oil and the varying pressure of the compresor crankcase. The sensor includes a body having a chamber therein with a fluid-tight wall at one end of the chamber. A piston is slidably disposed in the chamber and movable relative to the fluid-tight wall in opposite directions with resilient means within the chamber continuously urging the piston in one of the opposite directions relative to the fluid-tight wall. The sensor has first means to apply the varying pressure of the compressor crankcase to the chamber on one side of the piston having the force of the resilient means applied thereto and second means to apply the pressure of the oil supplied from the pump to the chamber on the other side of the piston so that the position of the piston in the chamber is determined by the difference between the force exerted by the actual pressure of the oil supplied from the pump and the force of the resilient means. The sensor has indicating means exterior of the chamber and always responsive to the position of the piston relative to the fluidtight wall to indicate when the actual pressure of the fluid supplied from the pump has changed conditions relative to the predetermined pressure. The indicating means is disposed adjacent the fluid-tight wall, and the piston includes activating means in its end adjacent the fluid-tight wall to activate the indicating means when the piston is in the position in which the actual pressure of the oil has changed conditions relative to the predetermined pressure.

The attached drawings illustrate a preferred embodiment of the invention, in which.

Figure 1:
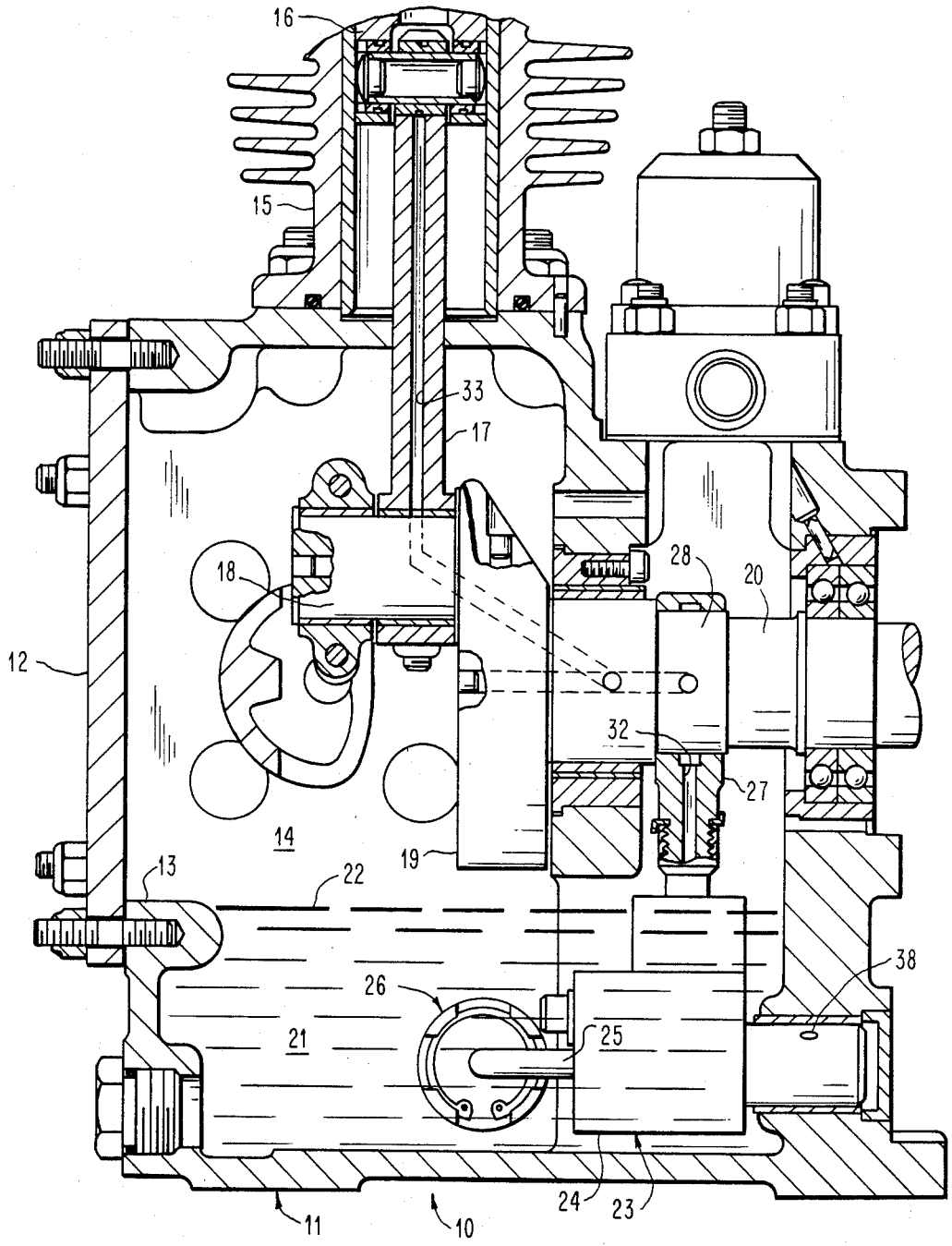
FIG. 1 is a fragmentary sectional view of a portion of a compressor having a fluid pressure sensor of the present invention for sensing the actual oil pressure discharged from an oil pump in the crankcase of the compressor.

Referring to the drawings and particularly FIG. 1, there is shown a compressor 10 including a housing or body 11. The housing or body 11 includes an end cover 12 closing an opening 13 which provides access to a crankcase 14 within the housing 11.

The compressor 10 has a plurality of cylinders 15 (one shown) attached to the housing 11 with each of the cylinders 15 having a piston 16 reciprocating therein. Each of the cylinders 15 has inlet and discharge valves in its end in the manner shown in the aforesaid Allen patent.

The piston 16 is connected by a rod 17 to a crank pin 18 having an integral counterweight 19, which is at the end of a crankshaft 20. The crankshaft 20, which is rotatably supported within the housing 11, is driven by any suitable means cooperating with a portion of the crankshaft 20 extending exteriorly of the housing 11.

The crankcase 14 has oil 21 therein to a selected level 22 which is below the opening 13 in the housing 11 closed by the end cover 12. The oil 21 is supplied under pressure from an oil pump 23 to various portions of the compressor 10. The pump 23 includes a body 24 (see FIGS. 2-4) having an intake pipe 25 to receive the oil 21 from the crankcase 14. An oil strainer assembly 26 (see FIGS. 2 and 3) surrounds the intake pipe 25 to prevent particles from entering the intake pipe 25.

The pump 23 includes a plunger 27 having one end surrounding an eccentric 28 (see FIG. 1) of the crankshaft 20 so that rotation of the crankshaft 20 causes reciprocation of the plunger 27. When the plunger 27 moves upwardly, a ball check valve 29 (see FIGS. 2 and 4) is closed while an inlet poppet valve 30 is opened to allow the oil 21 to flow into a cylinder 30' beneath the closed ball check valve 29. A spring 31 urges the inlet poppet valve 30 to its closed position.

When the plunger 27 moves downwardly, the ball check valve 29 is opened by the oil pressure in the cylinder 30' while the spring 31 in conjunction with the oil pressure in the cylinder 30' closes the inlet poppet valve 30. With the ball check valve 29 open and the inlet poppet valve 30 closed, the oil flows upwardly through a passage 32 in the plunger 27 for supply to various portions of the compressor 10 such as through a passage 33 (see FIG. 1), for example, in the piston rod 17.

Figure 3:
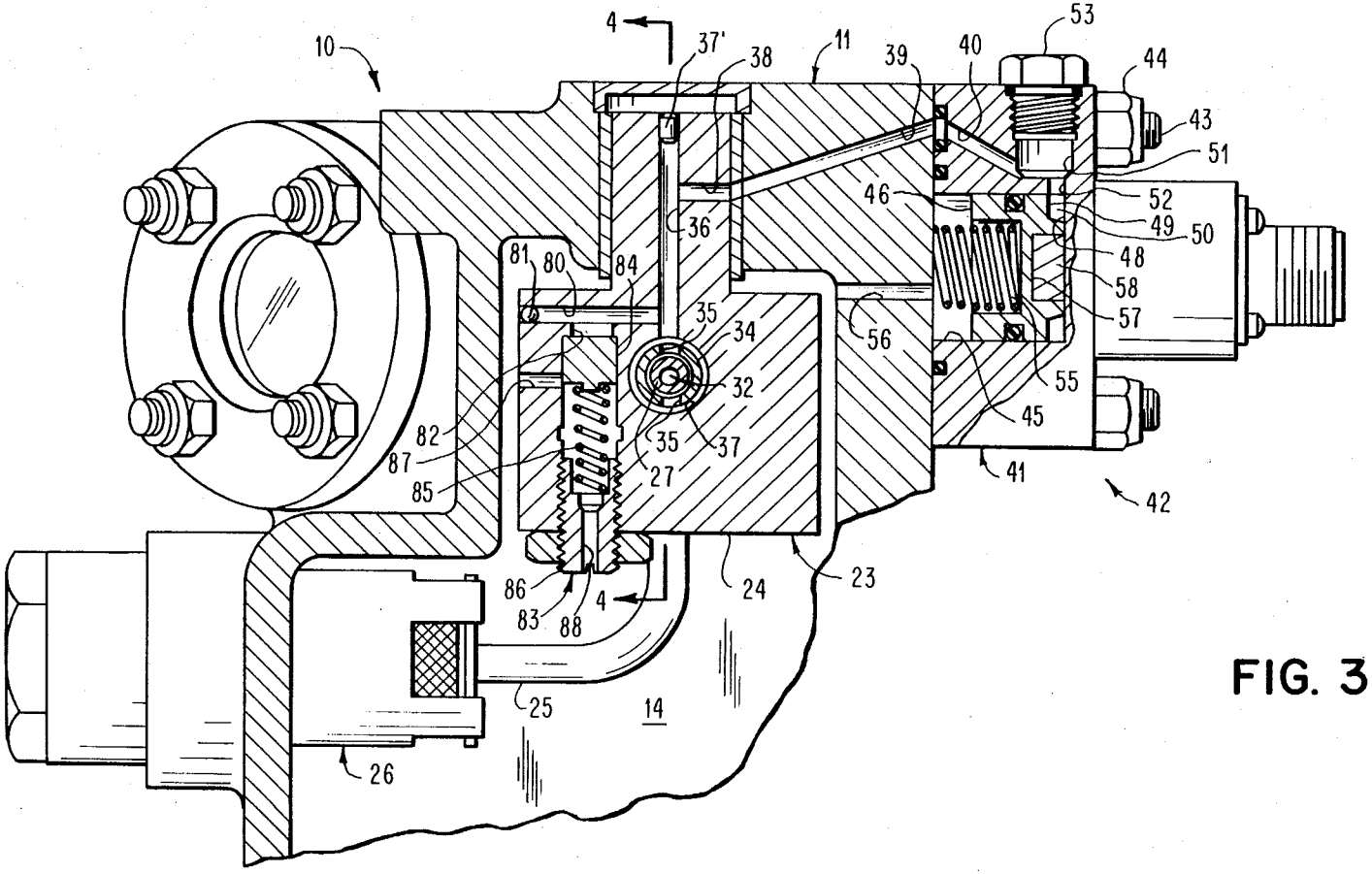
FIG. 3 is a fragmentary sectional view, partly in plan, of the compressor of FIG. 2 including the fluid pressure sensor of the present invention and taken along line 3—3 of FIG. 2.
Figure 4:
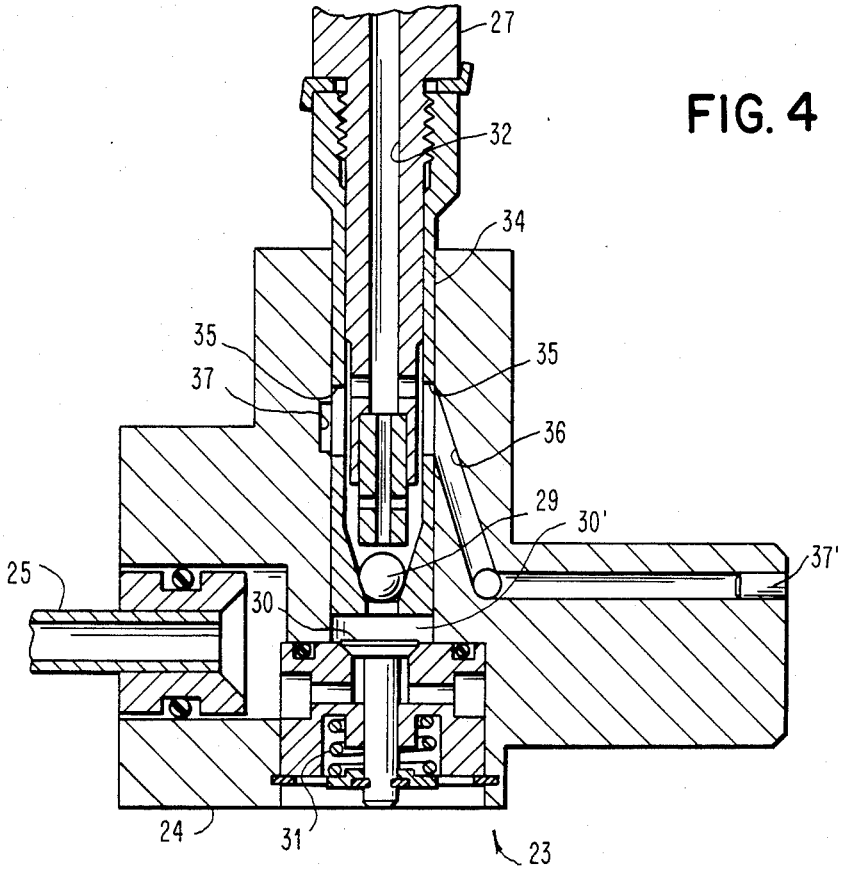
FIG. 4 is a fragmentary sectional view, partly in elevation, of the fluid pressure sensor of the present invention and taken along line 4—4 of FIGS. 2 and 3.

As the plunger 27 reciprocates, oil also passes from the interior of a plunger piston 34 (see FIGS. 3 and 4), which is threadedly connected to the plunger 27, through a pair of diametrically disposed openings 35 in the plunger piston 34 into a passage 36 in the pump body 24 by an annular recess 37 in the body 24 between the passage 36 and the plunger piston 34. As shown in FIG. 3, the passage 36, which has its end closed by a plug 37', communicates through a passage 38 in the pump body 24 to a passage 39 in the compressor housing 11. Thus, the oil pressure in the oil pump 23 is applied to the passage 39.

The passage 39 communicates with a passage 40 in a body 41 of an oil pressure sensor 42. The body 41 is mounted on the compressor housing 11 by threaded studs 43 extending from the compressor body 11 and nuts 44.

The body 41 of the oil pressure sensor 42 includes a piston chamber 45 within which a piston 46 may reciprocate. One end of the piston 46 has a reduced portion 47 (see FIG. 2) so that when the reduced portion 47 abuts a fluid-tight wall 48 of the body 41, an annular surface 49 of the piston 46 is spaced from the fluid-tight wall 48 of the body 41 to provide an annular portion 50 of the chamber 45 to which fluid pressure in the passage 40 (see FIG. 3) in the body 41 is applied through a recess 51 in the body 41 and a passage 52 in the body 41. The recess 51 is closed by a plug 53. Accordingly, the pressure of the oil from the pump 23 always acts on one side of the piston 46 irrespective of the position of the piston 46 within the chamber 45 in the body 41 of the oil pressure sensor 42.

The piston 46 has a recess 54 (See FIG. 2) on its opposite side from the annular surface 49 to receive one end of a spring 55, which has its other end abutting the compressor housing 11. The spring 55 continuously urges the piston 46 towards the fluid-tight wall 48.

The chamber 45 communicates with the crankcase 14 through a passage 56 in the compressor housing 11. Therefore, the side of the piston 46 having the spring 55 acting thereon is subjected to the varying pressure in the crankcase 14.

The fluid pressure applied to the annular surface 49 of the piston 46 is the pressure produced by the oil pump 23. This includes both the actual pressure of the oil discharged from the oil pump 23 and the varying pressure of the crankcase 14. This is because the intake pipe 25 communicates with the crankcase 14.

Therefore, the position of the piston 46 within the chamber 45 is controlled by the actual pressure produced by the oil pump 23. The position of the piston 46 within the chamber 45 is dependent upon the difference between the force exerted by the actual pressure of the oil from the pump 23 and the force exerted by the spring 55.

The piston 46 has a recess 57 in the reduced portion 47. A magnet 58 is mounted in the recess 57 so that one of its magnetic poles is closest to the fluid-tight wall 48.

The body 41 has a chamber 59 on the opposite side of the fluid-tight wall 48 from the chamber 45. A magnetically activated switch 60, which is preferably a Hall Effect integrated circuit device, is supported on the fluid-tight wall 48 so that it will be affected by the magnetic field created by the magnet 58 when the piston 46 is in the position shown in FIG. 2 in which the reduced portion 47 of the piston 46 abuts the fluid-tight wall 48 or when the reduced portion 47 of the piston 46 is slightly spaced from the fluid-tight wall 48 but is close enough that the magnetically activated switch 60 can be activated by the magnetic field of the magnet 58. Thus, the magnetically activated switch 60 is responsive to the piston 46 being in the position in which the actual pressure of the oil from the oil pump 23 is less than a predetermined pressure. This is when it is desired to provide a signal that the actual oil pressure from the oil pump 23 has decreased below the predetermined pressure.

One suitable example of the magnetically activated switch 60 is a unipolar digital switch sold by Sprague Electric Company, Concord, N.H. as type UGN-3013T and utilizing a Hall Effect integrated circuit responsive to the magnetic field in which the South pole of the magnet 58 is closest to the switch 60.

Figure 5:
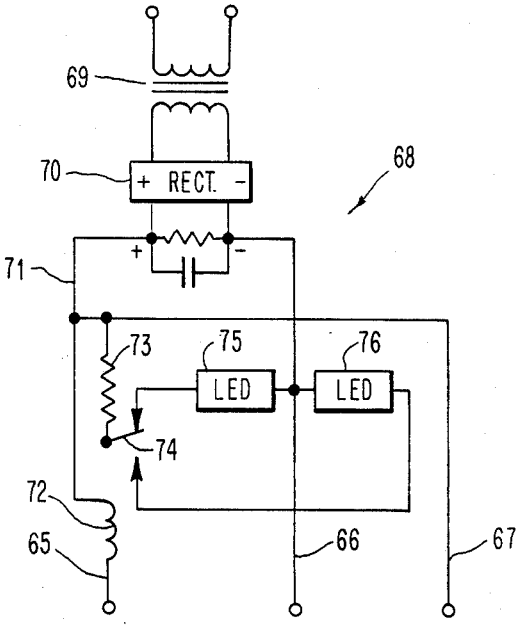
FIG. 5 is a schematic wiring diagram of a signal indicator used in conjunction with the fluid pressure sensor of the present invention.

The magnetically activated switch 60 has three conductors 61, 62, and 63 extending therefrom and connected through a connector 64, which is secured to the end of the body 41, with conductors 65 (see FIG. 5), 66, and 67, respectively, of a signal indicator 68. The signal indicator 68 includes a transformer 69 for reducing the AC voltage to 6.3 volts, which is then rectified by a full wave rectifier 70. This produces a +10 volt supply over a conductor 71 to the conductor 65, which has a coil 72 of a relay therein, and to the conductor 67. The +10 volt supply on the conductor 71 also is supplied through a resistor 73 to a relay contact 74, which has its position controlled by the relay coil 72. The conductor 67 supplies the +10 volts through the conductor 63 (see FIG. 2) to transistors of the magnetically activated switch 60. The conductor 66 (see FIG. 5) is a return from the transistors of the magnetically activated switch 60 (see FIG. 2) by the conductor 62 to the negative side of the rectifier 70 (see FIG. 5).

When the reduced portion 47 (see FIG. 2) of the piston 46 is not close enough to the fluid-tight wall 48 of the body 41 so that the magnetically activated switch 60 cannot be activated by the magnetic field of the magnet 58, a circuit within the magnetically activated switch 60 is opened so that the conductors 61 and 62 are not connected to each other whereby the relay coil 72 (see FIG. 5) is not energized. As a result, the relay contact 74 is in the position shown in FIG. 5 whereby a light emitting diode (LED) 75, which may be green, is energized. This indicates that the actual oil pressure from the pump 23 (see FIG. 2) is satisfactory as it is not less than the predetermined pressure.

However, when the magnetically activated switch 60 is activated because of the reduced portion 47 of the piston 46 being close enough to the fluid-tight wall 48 of the body 41 that the magnetic field of the magnet 58 will activate the magnetically activated switch 60, the conductors 61 and 62 are connected to each other through activation of the circuit within the magnetically activated switch 60. This energizes the relay coil 72 (see FIG. 5) to change the position of the relay contact 74 so that an LED 76, which may be red, for example, is energized. This indicates that the actual pressure of the oil 21 (see FIG. 2) in the oil pump 23 has decreased below the predetermined pressure.

This predetermined pressure is substantially below the pressure at which the oil pump 23 operates. For example, the pressure of the oil from the oil pump 23 might vary between 25 p.s.i. and 30 p.s.i during reciprocation of the plunger 27. However, it is only desired to indicate when the actual pressure of the oil from the oil pump 23 has decreased to 5 p.s.i., for example, before the warning signal is produced.

The passage 36 (see FIG. 3) in the body 24 also communicates with a passage 80, which is closed by a plug 81, in the body 24. The passage 80 communicates with a passage 82 in the body 24 having a relief valve 83 therein. The relief valve 83 includes a piston 84 having one end subjected to the pressure in the passage 80 and its other end subjected to the force of a spring 85. The spring 85 has its other end acting against an adjustable stop 86 to vary the force of the spring 85.

When the pressure from the oil pump 23 exceeds a predetermined maximum, the spring 85 is overcome, and the piston 84 moves to allow the passage 80 to communicate with a passage 87 in the body 24 so that the oil 21 (see FIG. 1) is returned to the crankcase 14. Thus, the relief valve 83 (see FIG. 3) prevents the oil pressure of the oil pump 23 from becoming too high. It should be understood that the adjustable stop 86 has a vent passage 88 to allow the oil 21 (see FIG. 1) between the piston 84 (see FIG. 3) and the adjustable stop 86 to be vented when the piston 84 is moved against the force of the spring 85.

Since the intake pipe 25 of the oil pump 23 communicates with the crankcase 14, the discharge pressure of the oil from the oil pump 21 includes the pressure in the crankcase 14 and the actual pressure of the oil from the oil pump 23. Because the pressure in the crankcase 14 varies substantially since the crankcase 14 is vented to the inlet of the compressor 10 so that the pressure in the crankcase 14 is the same as the pressure of the fluid entering the compressor 10 with this entering pressure varying substantially, this varying pressure in the crankcase 14 does not affect when the signal indicator 68 (see FIG. 5) indicates that the actual pressure is below the predetermined pressure. Instead, the actual pressure of the oil discharged from the oil pump 23 (see FIG. 3) is the pressure sensed by the oil pressure sensor 42.

While the oil pressure sensor 42 has been shown and described as sensing when the pressure of the oil pump 23 decreases below a predetermined pressure, it should be understood that the oil pressure sensor 42 could be utilized when it is desired to sense that an actual fluid pressure exceeds a predetermined pressure. This would necessitate the LEDs 75 (see FIG. 5) and 76 to be reversed in color with the spring 55 in the position shown in FIGS. 2 and 3.

Figure 2:
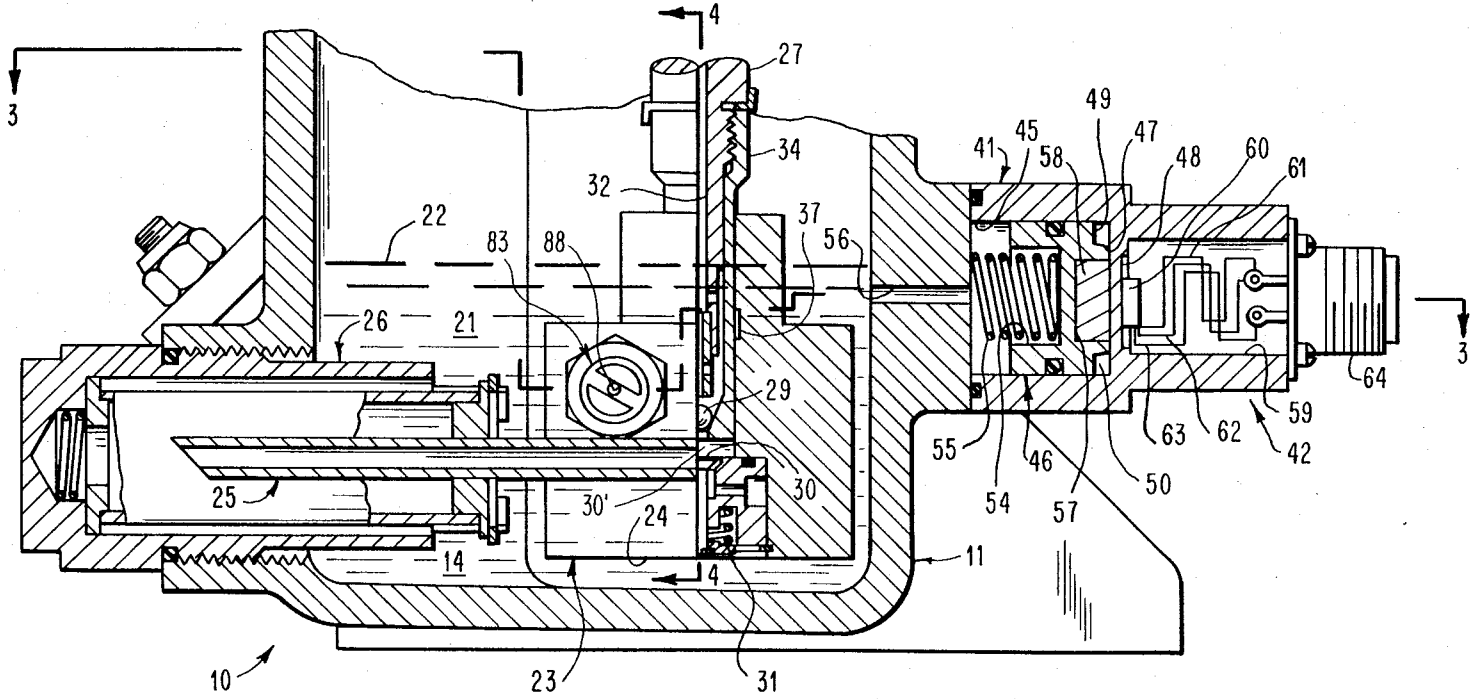
FIG. 2 is a fragmentary sectional view of a portion of the compressor of FIG. 1 including the fluid pressure sensor of the present invention.

However, if the spring 55 were to be disposed on the opposite side of the piston 46 from that shown in FIGS. 2 and 3 and the pressure from the oil pump 23 and the pressure from the crankcase 14 applied to the opposite sides of the piston 46 from that shown and described, it would not be necessary to reverse the colors of the LEDs 75 (see FIG. 5) and 76 when it is desired to sense that an actual fluid pressure exceeds a predetermined pressure. Likewise, if the spring 55 (see FIGS. 2 and 3) were positioned on the opposite side of the piston 46 from that shown in FIGS. 2 and 3 with the pressure from the oil pump 23 and the pressure from the crankcase 14 applied to the opposite sides of the piston 46 from that shown and described, the reversal of the colors of the LEDs 75 (see FIG. 5) and 76 would enable sensing of the actual pressure of the oil pump 23 (see FIG. 2) when it is below the predetermined pressure to be indicated by the LED 75 (see FIG. 5).

It should be understood that the magnetically activated switch 60 (see FIG. 2) may be other than the Hall Effect integrated circuit switch. It is only necessary that a device be mounted exterior of the chamber 45 and be responsive to the presence or absence of the position of the piston 46 adjacent the fluid-tight wall 48.

While the oil pressure sensor 42 has been shown as being utilized with the oil 21, it should be understood that the oil pressure sensor 42 is a fluid pressure sensor that may be employed with any liquid or gas to sense an actual fluid pressure where there is a varying ambient pressure as part of the total fluid pressure. Thus, the fluid pressure sensor of the present invention has utility wherever there is a varying ambient pressure to affect an actual fluid pressure whose value it is desired to know relative to a predetermined pressure.

While the LEDs 75 (see FIG. 5) and 76 have been shown and described as providing the indicating signals, it should be understood that any suitable indicating means may be employed. For example, an audio signal means could be used to indicate when the actual oil pressure has changed conditions relative to a predetermined pressure so that it is either lesser or greater than the predetermined pressure.

An advantage of this invention is that there is no false signal received when the crankcase pressure falls to decrease the total sensed oil pressure. Another advantage of this invention is that the actual pressure of a fluid from pressurizing means having its intake in a varying ambient pressure is obtained.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

We claim:

1. A fluid pressure sensor for always indicating when the actual pressure of an oil supplied from a pump in which the pump receives the oil from a compressor crankcase having a varying pressure has changed from the condition of being greater or lesser than a predetermined pressure to the opposite condition where the total pressure of the oil supplied from the pump includes both the actual pressure of the oil and the varying pressure of the compressor crankcase including:

a body having a chamber therein;

said body including a fluid-tight wall at one end of said chamber;

a piston slidably disposed in said chamber and movable relative to said fluid-tight wall in opposite directions;

resilient means within said chamber to continuously urge said piston in one of the opposite directions relative to said fluid-tight wall;

first means to apply the varying pressure of the compressor crankcase to said chamber on one side of said piston having the force of said resilient means applied thereto and second means to apply the pressure of the oil supplied from the pump to said chamber on the other side of said piston so that the position of said piston in said chamber is determined by the difference between the force exerted by the actual pressure of the oil supplied from the pump and the force of said resilient means;

indicating means exterior of said chamber and always responsive to the position of said piston relative to said fluid-tight wall to indicate when the actual pressure of the oil supplied from the pump has changed conditions relative to the predetermined pressure;

said indicating means being disposed adjacent said fluid-tight wall;

and said piston including activating means in its end adjacent said fluid-tight wall to activate said indicating means when said piston is in the position in which the actual pressure of the oil has changed conditions relative to the predetermined pressure.

2. The sensor according to claim 1 in which:

said activating means of said piston includes a magnet;

and said indicating means includes means responsive to a magnetic field created by said magnet.

3. The sensor according to claim 1 in which said body is mounted exterior of the compressor crankcase.

4. The sensor according to claim 1 in which said second means includes passage means in said body communicating said chamber on the other side of said piston and said pump.

5. A fluid pressure sensor for always indicating when the actual pressure of an oil supplied from a pump in which the pump receives the oil from a compressor crankcase having a varying pressure is less than a predetermined pressure where the total pressure of the oil supplied from the pump includes both the actual pressure of the oil and the varying pressure of the compressor crankcase including:

a body having a chamber therein;

said body including a fluid-tight wall at one end of said chamber;

a piston slidably disposed in said chamber and movable relative to said fluid-tight wall in opposite directions;

resilient means within said chamber to continuously urge said piston in one of the opposite directions relative to said fluid-tight wall;

first means to apply the varying pressure of the compressor crankcase to said chamber on one side of said piston having the force of said resilient means applied thereto and second means to apply the pressure of the oil supplied from the pump to said chamber on the other side of said piston so that the position of said piston in said chamber is determined by the difference between the force exerted by the actual pressure of the oil supplied from the pump and the force of said resilient means;

indicating means exterior of said chamber and always responsive to the position of said piston relative to said fluid-tight wall to indicate when the actual pressure of the oil supplied from the pump is less than the predetermined pressure;

said indicating means being disposed adjacent said fluid-tight wall;

and said piston including activating means in its end adjacent said fluid-tight wall to activate said indicating means when said piston is in the position in which the actual pressure of the oil is less than the predetermined pressure.

6. The sensor according to claim 5 in which:

said activating means of said piston includes a magnet;

and said indicating means includes means responsive to a magnetic field created by said magnet.

7. The sensor according to claim 5 in which said body is mounted exterior of the compressor crankcase.

8. The sensor according to claim 5 in which said second means includes passage means in said body communicating said chamber on the other side of said piston and said pump.

9. A fluid pressure sensor for always indicating when the actual pressure of an oil supplied under pressure from a pump in which the pump receives the oil from a compressor crankcase having a varying pressure is greater than a predetermined pressure where the total pressure of the oil supplied from the pump includes both the actual pressure of the oil and the varying pressure of the compressor crankcase including:

a body having a chamber therein;

said body including a fluid-tight wall at one end of said chamber;

a piston slidably disposed in said chamber and movable relative to said fluid-tight wall in opposite directions;

resilient means within said chamber to continuously urge said piston in one of the opposite directions relative to said fluid-tight wall;

first means to apply the varying pressure of the compressor crankcase to said chamber on one side of said piston having the force of said resilient means applied thereto and second means to apply the pressure of the oil supplied from the pump to said chamber on the other side of said piston so that the position of said piston in said chamber is determined by the difference between the force exerted by the actual pressure of the oil supplied from the pump and the force of said resilient means;

indicating means exterior of said chamber and always responsive to the position of said piston relative to said fluid-tight wall to indicate when the actual pressure of the oil supplied from the pump is greater than the predetermined pressure;

said indicating means being disposed adjacent said fluid-tight wall;

and said piston including activating means in its end adjacent said fluid-tight wall to activate said indicating means when said piston is in the position in which the actual pressure of the oil is greater than the predetermined pressure.

10. The sensor according to claim 9 in which:

said activating means of said piston includes a magnet;

and said indicating means includes means responsive to a magnetic field created by said magnet.

11. The sensor according to claim 9 in which said body is mounted exterior of the compressor crankcase.

12. The sensor according to claim 9 in which said second means includes passage means in said body communicating said chamber on the other side of said piston and said pump.

* * * * *

UNITED STATES PATENT AND TRADEMARK OFFICE

CERTIFICATE OF CORRECTION

PATENT NO. : 4,669,960

DATED : June 2, 1987

INVENTOR(S) : Clifford W. Allen, Jr. et al

It is certified that error appears in the above-identified patent and that said Letters Patent is hereby corrected as shown below:

Column 2, line 9, "compresor" should read -- compressor --.

line 28, "fluidtight" should read -- fluid-tight --.

Column 3, line 67, "See" should read -- see --.

Signed and Sealed this

Twenty-seventh Day of October, 1987

*Attest:*

DONALD J. QUIGG

*Attesting Officer*

*Commissioner of Patents and Trademarks*